US006702723B2

(12) United States Patent
Landfair

(10) Patent No.: US 6,702,723 B2
(45) **Date of Patent: *Mar. 9, 2004**

(54) WEIGHTLIFTING PLATE

(75) Inventor: Craig D. Landfair, Ventura, CA (US)

(73) Assignee: Hampton Fitness Products, Ltd., Ventura, CA (US)

( * ) Notice: Subject to any disclaimer, the term of this patent is extended or adjusted under 35 U.S.C. 154(b) by 96 days.

This patent is subject to a terminal disclaimer.

(21) Appl. No.: 09/953,716

(22) Filed: Sep. 17, 2001

(65) Prior Publication Data

US 2002/0022557 A1 Feb. 21, 2002

Related U.S. Application Data

(63) Continuation of application No. 09/364,549, filed on Jul. 28, 1999, now Pat. No. 6,319,176.

(51) Int. Cl.[7] ..... A63B 21/06; A63B 21/072

(52) U.S. Cl. ..... 482/93; 482/98; 482/106; 482/108

(58) Field of Search ..... 482/44–46, 49, 482/50, 79, 92, 93, 139, 97–110, 140; D21/680–682, 679, 683, 684; 16/400, 425, DIG. 8; 220/574, 573.1

(56) References Cited

U.S. PATENT DOCUMENTS

| | | | | | |
|---|---|---|---|---|---|
| 3,920,347 | A | * | 11/1975 | Sauriol et al. | 404/25 |
| 4,199,140 | A | * | 4/1980 | Ferretti | 482/106 |
| 4,369,968 | A | * | 1/1983 | Price | 482/106 |
| 4,431,185 | A | * | 2/1984 | Cisneros | 482/93 |
| 4,618,142 | A | * | 10/1986 | Joseph, Jr. | 482/82 |
| 4,714,246 | A | * | 12/1987 | Parisien | 482/110 |
| 4,743,018 | A | * | 5/1988 | Eckler | 482/106 |
| D299,373 | S | * | 1/1989 | Parker et al. | D21/682 |
| 4,995,604 | A | * | 2/1991 | Lynch et al. | 482/55 |
| 5,137,502 | A | * | 8/1992 | Anastasi | 482/106 |
| 5,344,375 | A | * | 9/1994 | Cooper | 482/106 |
| D355,007 | S | * | 1/1995 | Rojas et al. | D21/681 |
| 5,692,996 | A | * | 12/1997 | Widerman | 482/93 |
| 5,709,634 | A | * | 1/1998 | Pointer | 482/105 |
| 5,716,305 | A | * | 2/1998 | Selsam | 482/93 |
| 5,741,206 | A | * | 4/1998 | Anastasi | 482/105 |
| 5,853,355 | A | * | 12/1998 | Standish | 482/106 |
| D406,183 | S | * | 2/1999 | Zovich | D21/680 |
| D428,947 | S | * | 8/2000 | Harms et al. | D21/680 |
| D450,361 | S | * | 11/2001 | Harms et al. | D21/681 |
| 6,319,176 | B1 | * | 11/2001 | Landfair | 482/93 |
| 6,436,015 | B1 | * | 8/2002 | Frasco et al. | 482/106 |
| D474,517 | S | * | 5/2003 | Harms | D21/681 |
| 2001/0049324 | A1 | * | 12/2001 | Wallace et al. | 482/106 |
| 2002/0091044 | A1 | * | 7/2002 | Lien et al. | 482/106 |
| 2003/0083179 | A1 | * | 5/2003 | Landfair | 482/93 |

FOREIGN PATENT DOCUMENTS

| | | | | |
|---|---|---|---|---|
| JP | 406158675 | A | * | 6/1994 |

* cited by examiner

*Primary Examiner*—Jerome W. Donnelly
*Assistant Examiner*—Victor Hwang
(74) *Attorney, Agent, or Firm*—J. Charles Dougherty

(57) ABSTRACT

A weight plate having rotatable handles is disclosed. By rotating, the handles provide a sure grip to the user, while allowing the user to perform various exercises without adjusting his or her grip on the device. The handles also facilitate the safe loading and unloading of the device on plate-loaded exercise equipment. The weight plate may thus be used as a stand-alone exercise device, as a weight plate loaded onto a barbell or dumbbell bar, or as a weight plate used on plate-loaded exercise equipment.

17 Claims, 2 Drawing Sheets

WEIGHTLIFTING PLATE

This application is a continuation of application Ser. No. 09/364,549, filed on Jul. 28, 1999, now U.S. Pat. No. 6,319,176 B1, which is incorporated herein by reference.

FIELD OF THE INVENTION

The present invention relates to exercise devices, and in particular relates to weightlifting plates.

BACKGROUND OF THE INVENTION

Gymnasiums weight rooms, fitness centers, sports training centers, and other areas where weight training equipment is used have traditionally maintained one or both of two broad categories of weight-training equipment. Free weights, the first category of equipment, includes such well-known devices as dumbbells and barbells. Free weights are preferred by many athletes and weight-training enthusiasts because such devices allow full, natural movement during exercise. Since the movement of such devices are fully controlled by the user, these movements are dictated by the natural, curving movements of the human body. For example, a user performing a curl with a dumbbell may begin from a position with the dumbbell held directly below the shoulder with the arm extended downward. From this position, the user bends his or her arm at the elbow, which brings the dumbbell upward in a natural, curving movement. Finally, the dumbbell may be brought to rest against the user's chest and upper arm. During such a movement, the user need not adjust his or her grip on the dumbbell, because the bar does not rotate relative to the user's hand. In addition, the user's wrist is allowed full movement, providing for a graceful, curved, natural motion during exercise.

Although free weights allow a full range of movement during exercise, they do possess certain disadvantages. The primary disadvantage is a lack of convenience. Most dumbbells are constructed to have a certain amount of weight, and thus when a user wants to change the amount of weight, the user must switch dumbbells. This usually requires the user to return the dumbbell being used to an equipment rack, select another dumbbell, and then return to the exercise area. Other dumbbells are constructed so that the user may adjust the weight by either substituting weighted plates of different sizes, or by attaching additional plates. With these dumbbells, the user must remove the locking mechanisms (typically a collar) on each end of the bar, remove the already attached weighted plates if required, attach the desired weighted plates, then reattach the locking mechanisms. With either type of dumbbell, the process of changing the amount of weight used is time-consuming and laborious. This is particularly a problem when a number of users are taking turns using a single piece of equipment, since each user's natural abilities and skill level may require a different amount of weight for a given exercise. A common example of this problem is a football team; an appropriate amount of weight for a particular exercise may vary considerably between the large, strong linemen and the more nimble but less muscular receivers.

To provide greater convenience for multiple users, a second category of weight training equipment developed, known as "stack-loaded" or "selectorized" equipment. Such equipment employs a stack of weighted plates that are connected by cables and pulleys to handles that the user may grip. By moving the position of a pin within the stack of weighted plates, the user may easily and quickly manipulate the amount of weight employed for a particular exercise.

This is particularly convenient when a number of users are taking turns at a single piece of equipment, since each user needs simply to move the pin to the amount of weight desired for the particular exercise. Such equipment largely solves the problem of inconvenience created by multiple users of varying skill and strength taking turns with a particular piece of equipment. The disadvantage of selectorized equipment, however, is that the movements employed in the use of such equipment are rigid and unnatural, and make it difficult for the user to isolate particular muscles or muscle groups for development. For example, performing a bench press exercise on a selectorized bench press or "universal" machine would require the user to push up on a bar while gripping the bench press bar with both hands. The bar may be connected through a cable and a series of pulleys to a stack of plates. If, as is often the case, the user has one arm that is stronger than the other, the user's weaker arm will be allowed to simply follow the stronger arm, and perform little of the work during the exercise. Thus such equipment does not allow the user to easily isolate particular muscles or muscle groups during exercise. Selectorized equipment also tends to force movement along straight lines, rather than along natural curves that mimic the natural movements of the human body. These straight lines simplify the design and construction of selectorized weight equipment, but also serve to reduce the user's ability to efficiently target particular muscle groups for development.

Another disadvantage experienced by the user exercising with selectorized equipment is that the user often must readjust his or her grip as the bar moves during each repetition of an exercise. This problem results from the fact that the bar typically does not turn with the user's hand as the exercise is performed. A dumbbell bar, on the other hand, naturally turns as the user's hand turns, and thus a firm grip may be maintained through the entire movement. This limitation of selectorized equipment also contributes to the sensation that exercise with such equipment feels less natural.

To partially address these limitations, selectorized equipment has in part been replaced in recent years with plate-loaded equipment. Instead of using stacked plates that are manipulated through cables and pulleys, plate-loaded equipment uses weighted plates with holes in the middle that are individually added or removed to the equipment using spindles. These plates may be similar to or identical to the plates used on some dumbbells and barbells. This approach allows greater flexibility in equipment design, and improves the ability of the equipment to isolate particular muscle groups during exercise. While not as convenient as selectorized equipment, plate-loaded equipment may be constructed to more closely follow the natural movements of the human body, and produce more comfortable and natural exercise routines. By adding or removing weight plates, the user can vary the amount of weight on a piece of plate-loaded equipment in much the same way as the user changes the amount of weight on a barbell or dumbbell.

Traditional weightlifting plates, or "weight plates," that are used on barbells, dumbbells, and plate-loaded equipment, are shaped as large, flat discs with a hole in the middle. Weight plates are generally designed primarily for attachment to a dumbbell or barbell bar. The plates slide onto one end of the bar through the hole, possibly in addition to other plates added on that end of the bar, and then are fastened into position by a bolt, collar, or some other locking means. By adding or removing weight plates of different sizes, the user may control the amount of weight on the bar.

In this way, the user is offered greater flexibility in the type of barbell or dumbbell exercises performed, and may tailor the weight chosen to the user's relative strength and weight-training goals without owning a multitude of dumbbells or barbells of different sizes. In gymnasiums and other facilities having both free weights and plate-loaded equipment, weight plates may be used on either type of equipment, since they may easily be removed from a barbell bar, for example, and then mounted onto the spindle of a piece of plate-loaded equipment. This allows the gym owner to avoid the purchase of expensive but duplicative equipment.

A third method of using weight plates is as a stand-alone training or exercise device. In particular, the "Olympic" style weight plates, which are typically quite large and constructed of iron, have been somewhat popular in years past for this purpose. These devices offer the user certain flexibility in the choice of training regimen that may not be available if only barbells and dumbbells are used. For example, a user may hold an Olympic plate against the user's abdomen during sit-up exercises to more quickly build muscle mass in the user's abdominal area. A dumbbell having similar weight would be far more bulky and unwieldy for this particular exercise. The prior art contains examples of weight plates that are designed to be particularly suited to stand-alone use; U.S. Pat. No. 5,692,996, to Widerman, discloses one such example.

Using a traditional weight plate as a stand-alone exercise device may create significant safety concerns. The only practical way for the user to grip such plates is for the user to hold the plate at the edges. This type of grip may be quite difficult or unsteady, depending upon the weight of the plate, the thickness of the plate, whether a thicker rim extends around the edge of the plate, the strength of the user's grip, and the size of the user's hands. In addition, as the user moves through various exercises, the user may need to change his or her grip position on the plate, which is especially difficult because the user is only holding the edge of a heavy plate. The risk of dropping such a plate during exercise increases each time the user is required to change grip positions. Also, the iron surface of an Olympic weight plate is relatively slick, which is only exacerbated when the user perspires through the course of an exercise routine. These same problems occur when the user is changing plates on a dumbbell or barbell bar, or even when the user is changing weight plates on plate-loaded equipment. In each case, maintaining a firm grip on the plate is a significant safety concern.

One proposed solution to the problem of securely gripping a weight plate is to add elongated holes through the surface of the plate. The user may then place his or her hands through the holes to grip the weight plate. U.S. Pat. No. 5,137,502 to Anastasi, and design pat. nos. 355,007 and 409,695, both to Rojas et al., disclose several such weight plates. In addition, commercial examples of such plates are now produced by the Irongrip Barbell Company of Fountain Valley, Calif. These plates have two or three holes through which the user may place his or her fingers, with the user's thumbs remaining on the side of the plate facing the user. If the plate is small enough, the user may place his or her fingers through one hole, and his or her thumb through another hole. Utilizing either of these gripping techniques, the plate may be held more securely because the user's hands actually extend through the plate. These designs reduce the risk of the user's hands slipping from the plate, since the fingers are "captured" to some degree within the holes passing through the plate.

Plates having elongated holes to receive the user's fingers may also facilitate certain types of exercises not possible with traditional weight plates. For example, the user wishing to perform a one-handed curl with a traditional plate would find it difficult to grip the plate in such a manner as to make this exercise possible. If the user gripped the plate along the edge, which is the only practical means of gripping a traditional weight plate, the user's grip would necessarily be somewhat precarious as the plate is raised. By contrast, a weight plate with elongated holes to receive fingers would allow the user to keep a more secure grip on the plate while bending the elbow and raising the plate toward the user's armpit. While this type of exercise is not a traditional curl, and would not follow the natural movements of the human body as a dumbbell curl would, the grip of the user would be more secure than that held along the edge of a traditional weight plate during such an exercise.

It would be difficult if not impossible to perform a full, traditional curl using such a weight plate, since as the user raises his or her hand toward the chest, and the wrist rolls inward, the plate would begin to extend horizontally outward, and away from the user. This problem results from the fact that the back of the user's hand and forearm would press against the plate. Because the user would have little leverage on the plate when it reaches this horizontally extended position, the user may not have sufficient strength to pull the plate up sufficiently to complete a traditional curl repetition. At best, this maneuver would be difficult and uncomfortable for the user. Other exercises would be similarly difficult or impossible because of the inherent limitations of the method of gripping such plates.

These plates with elongated holes also do not provide the user with a solution to the problem of changing his or her grip during each repetition of an exercise. For example, a user performing a traditional one-handed curl with one of these plates would be required to shift his or her grip on the plate as the plate is raised. In effect, the portion of the plate between the hole through which the user's hand is inserted and the rim of the plate must "roll" in the user's palm during this exercise. In fact, these plates may actually increase the severity of the grip-adjustment problem for certain exercises, since it may be more difficult for the user to change his or her grip while the hand is "captured" within a hole in the weight plate than when the grip is simply at the outer edge of a traditional Olympic plate. The user must necessarily release his or her grip on the weight plate somewhat in order to adjust his or her grip position, and thus the risk that the user will drop the plate increases. Also, constantly adjusting one's grip during repetitions of a particular exercise is uncomfortable for the user, reducing the user's willingness to continue the exercise and thereby reach the user's weight-training goals. This same problem is encountered as the user lifts such a weight plate to place it on the spindle of a piece of plate-loaded equipment. Thus a weight plate that both provides a more secure grip and does not require that the user shift his or her grip position during each repetition of an exercise or loading is desired.

SUMMARY OF THE INVENTION

The present invention overcomes the limitations of the prior art by providing a weight plate with rotatable handles. The rotatable handles give the user a sure grip that automatically turns in response to the user's movements so that the user need not adjust his or her grip on the device during exercise. The handles are attached to the weight plate in such a manner that the user has room around the handles to insert his or her hands. In one form, the present invention incorporates hollow shafts that are coaxially mounted around a rod to provide free rotation during exercise. When the user grips the present invention at one of these handles, the user can move through an exercise (for example, a traditional, one-handed curl) without releasing his or her grip with respect to the handle. The bar simply rotates during each repetition due to the force of gravity on the weight plate, so that the weight plate is always suspended directly below the bar.

An object of the present invention is, therefore, to provide a weight plate that provides a handle.

A further object of the present invention is to provide a weight plate that allows the user to perform various exercises without adjusting his or her grip position.

A further object of the invention is to provide a weight plate with handles that rotate during exercise.

Further objects and advantages of the present invention will be apparent from a consideration of the following detailed description of the preferred embodiments in conjunction with the appended drawings as briefly described following.

DETAILED DESCRIPTION OF THE PREFERRED EMBODIMENTS

Figure 1:
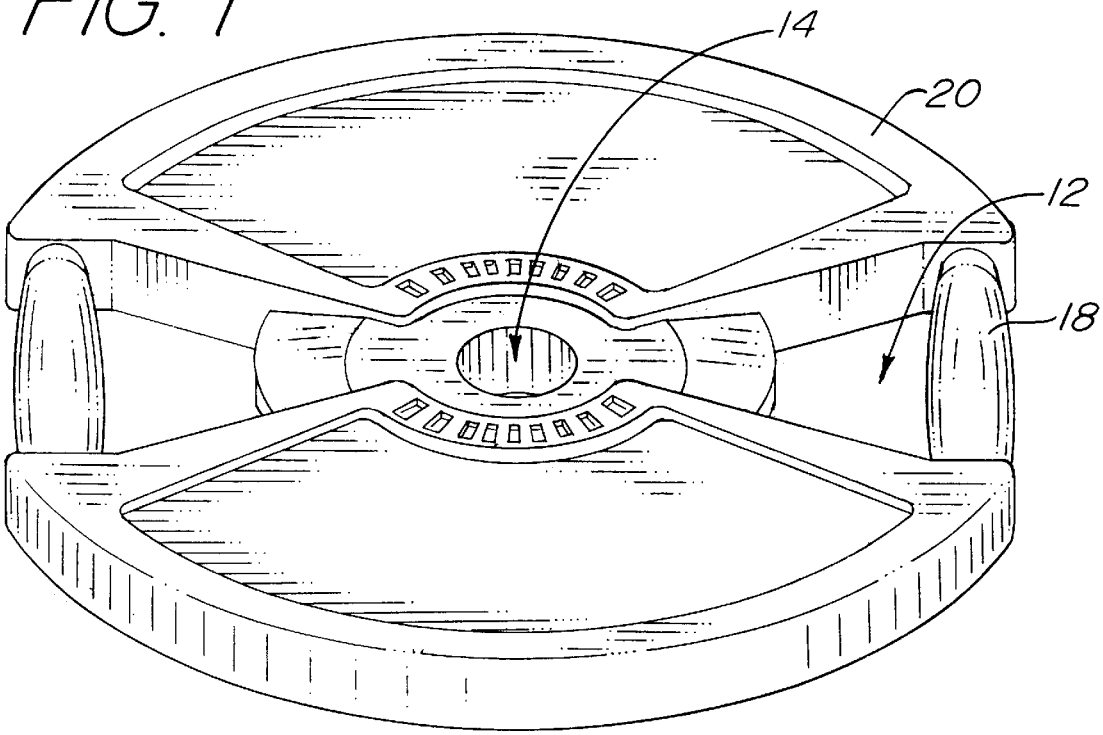
FIG. 1 is a top elevational view of a preferred embodiment of the present invention.
Figure 2:
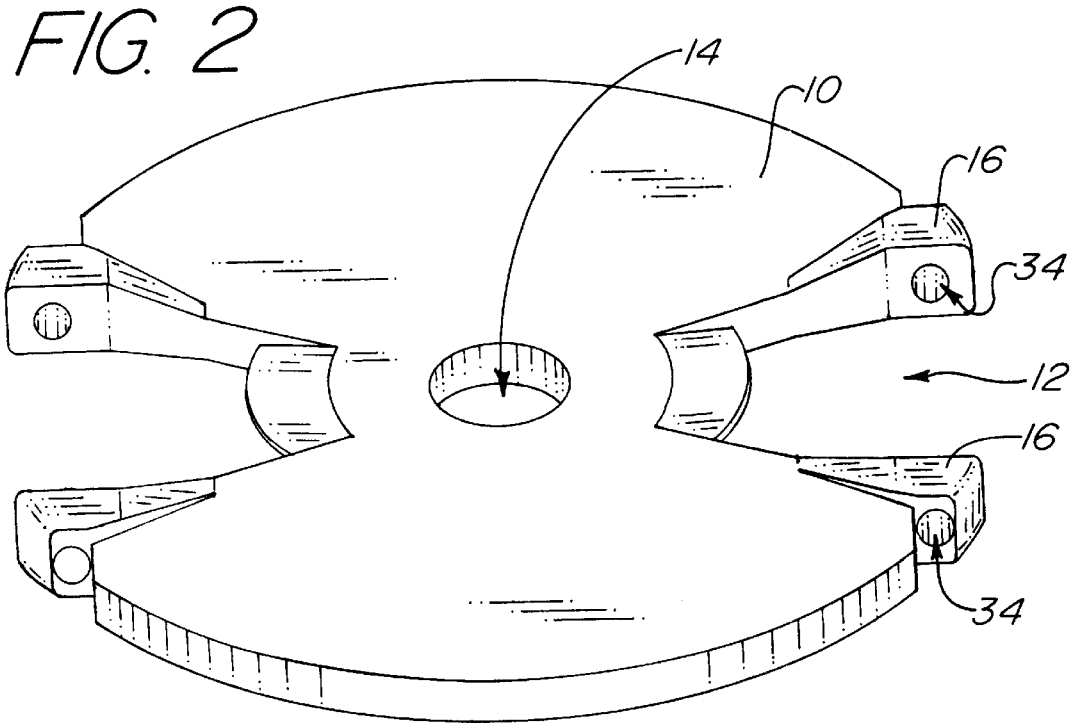
FIG. 2 is a top elevational view of the plate portion from a preferred embodiment of the present invention.

Referring now to FIGS. 1 and 2, a preferred embodiment of the present invention may be described. FIG. 2 shows plate 10, which forms the bulk of the weight of the preferred embodiment of the present invention. Plate 10 may come in various sizes to produce a finished product with various weights. For the United States market, the preferred embodiment of the invention is formed from plates 10 weighing 25, 35, and 45 pounds, while in the European market the preferred embodiment uses plates 10 with weights of 15, 25, and 35 kilograms. In the preferred embodiment, each of these plates 10 has the same diameter, with the thickness of each plates varying to increase or decrease the weight relative to other plates 10; however, plates 10 of varying diameters could also be used. It should be noted that while plate 10 may preferably be of a roughly disc-like shape, any of many other shapes may be utilized as well. The device may have rounded sides, or may be multi-sided, such as hexagonal or octagonal. The use of the term "plate" throughout is not intended to imply that the present invention is limited to a weight plate having a round, circular, flat, or disc-like form.

In the preferred embodiment, plate 10 has notches 12 lying at two opposite sides of plate 10. Plate 10 also has hole 14 through its center that is sized to fit barbell and dumbbell bars, as well as the spindles used to hold plates on plate-loaded equipment. Flanges 16 lie at each corner of the mouths of notches 12 at the periphery of plate 10. Flanges 16 are designed to receive the handle assembly 18 of a preferred embodiment of the invention, as described below.

Referring now to FIG. 1, the assembled preferred embodiment of the invention is shown. Handle assemblies 18 are installed in flanges 16 on plate 10. Plate 10 is covered with resilient coating 20. In the preferred embodiment, resilient coating 20 is shaped to make it appear that plate 10 is actually formed from three separate iron plates. Resilient coating 20 may also have decorative indentations, raised numerals indicating the weight of this particular version of the present invention, or company trademarks or marketing information embedded into its exterior surface. Resilient coating 20 may also include an indentation for the placement of a sticker or decal that bears a trademark. While resilient coating 20 is preferably formed of rubber, it may also be formed of urethane or other like materials. Because handle assemblies 18 are designed to be inserted into plate 10 after resilient coating 20 is applied, there is no need to trim resilient coating 20 around flanges 16, and there is no risk that the exterior portions of handle assemblies 18 will be damaged or discolored by the heat from the application of resilient coating 20.

Figure 3:
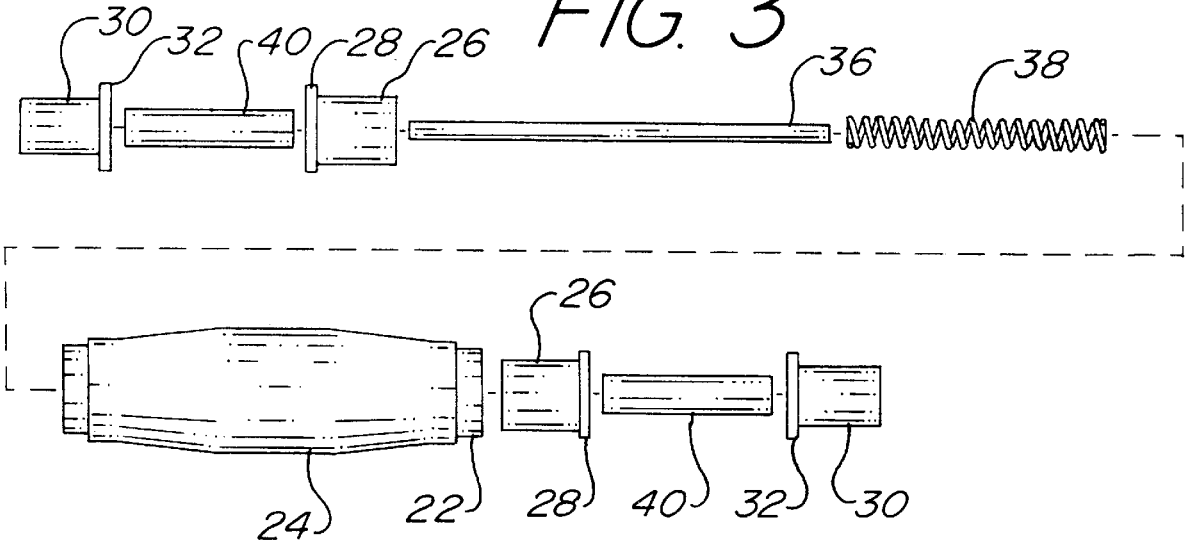
FIG. 3 is an exploded, perspective view of a handle assembly from a preferred embodiment of the present invention.
Figure 4:
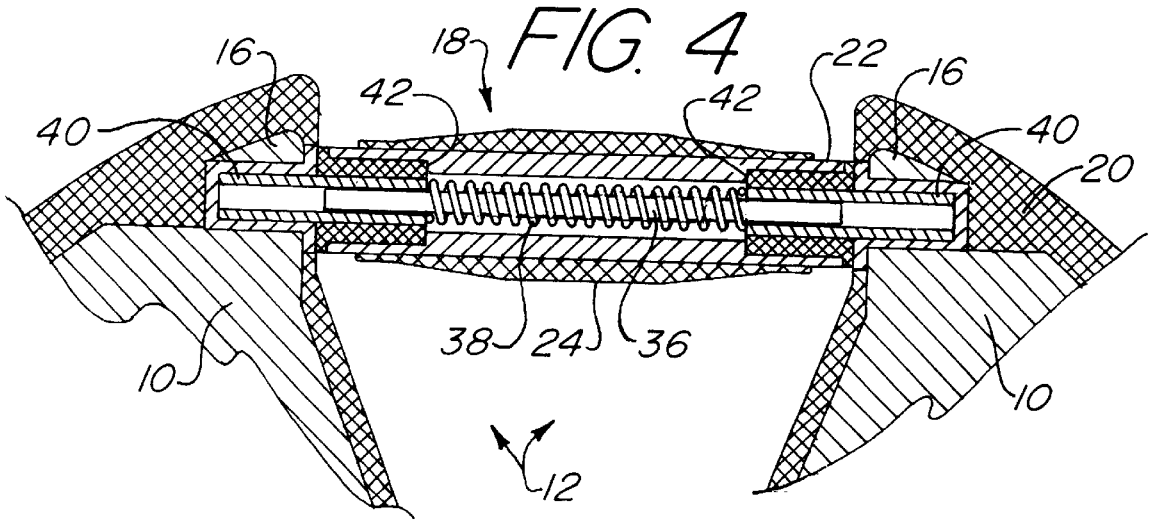
FIG. 4 is a detail, cut-away view of a handle assembly installed in the plate portion from a preferred embodiment of the present invention.

Referring now to FIGS. 3 and 4, the components of handle assemblies 18 may be described. Shaft 22 is a hollow, tube-shaped handle sized to fit well within the hands of most users. Preferably, shaft 22 is constructed of steel, but any sufficiently rigid and durable material may be substituted. Shaft 22 may preferably include a shaft lip 42 along its interior surface near each end. Shaft lip 42 is sized to receive the end of handle bushings 26 as described below. Grip 24 is applied to the exterior surface of shaft 22, and is ergonomically shaped to provide a comfortable and sure grip for the user. Grip 24 is preferably formed of rubber, but any sufficiently rugged and resilient material may be substituted. In an alternative embodiment, shaft 22 and grip 24 can be formed of a single piece of material, such that shaft 22 itself has an ergonomically-shaped gripping area. In yet another embodiment, shaft 22 may be used as first described above without the use of grip 24.

Handle bushings 26 are formed generally as a cylinder with a lip at one end, with both ends being open. Handle bushings 26 slide within shaft 22 at either end, and are sized to fit snugly within shaft 22, with the handle bushing lip 28 pressed against the opening at either end of shaft 22. In a preferred embodiment, handle bushings 26 are formed of nylon. Also in a preferred embodiment, the end of handle bushings 26 that slides within shaft 22 may rest on shaft lip 42 on the interior surface of shaft 22.

Plate bushings 30 are shaped similarly to handle bushings 26, except that plate bushings 30 are closed at the end opposite plate bushing lip 32. Plate bushings 30 are pressed into rider holes 34 on plate 10, and are sized to fit snugly within rider holes 34, with the plate bushing lip 32 pressed into the recess of rider holes 34 in each flange 16 of plate 10.

Rod 36 is fitted within shaft 22, with spring 38 fitted coaxially around rod 36. In one preferred embodiment, spring 38 may float freely over rod 36, but in an alternative preferred embodiment, rod 36 may include a tab (not shown) to hold spring 38 in place with respect to rod 36. Riders 40 slide over the ends of rod 36, compressing spring 38.

To install handle assembly 18 onto plate 10, riders 40 are pressed inward toward the center of shaft 22, such that riders 40 recess into shaft 22. Handle assembly 18 is then fitted between flanges 16 such that riders 40 are aligned with rider holes 34. When riders 40 are released, spring 38 forces riders 40 to extend into rider holes 34 and thereby hold handle assembly 18 in place in notch 12. Shaft 22 may freely rotate during use of the present invention, since handle bushings 26 may rotate with respect to riders 40, and riders 40 may rotate with respect to rod 36.

In an alternative embodiment of the present invention, rider holes 34 may extend entirely through flanges 16, and be sized to receive rod 36 directly. Rod 36 may then be secured in place using threadably attached nuts (not shown). In this embodiment, handle bushings 26, plate bushings 30, spring 38, and riders 40 may or may not be used. In the simplest form of this embodiment, shaft 22 would ride directly on rod 36, which may be sized to snugly fit within shaft 22. Yet another embodiment would include two bolts (not shown) that are threadably fittable within shaft 22 and pass through flanges 16 in rider holes 34; in this embodiment, handle bushings 26, plate bushings 30, spring 38, rod 36, and riders 40 may not be required.

As one example of the use of a preferred embodiment of the invention, the user may perform a one-handed curl in a more natural manner than with previous weight plates. The user may grip either handle assembly 18 just as the user would grip a dumbbell. As the user bends his or her elbow and draws the device upward, the handle shaft 22 will rotate in the user's hand so that the user need not adjust his or her grip during the exercise. As the device draws near to its highest point during the curl, the user's hand will actually curve under the handle assembly 18 and lie within the notch 12 corresponding to the handle assembly 18 that the user is gripping. Thus notch 12 allows a full, natural movement similar to that experienced with a dumbbell.

The handle assemblies 18 are also useful when the device is used as a weight plate for plate-loaded equipment. Handle assemblies 18 make loading and unloading of plates easier and safer since the user may securely grip the device using handle assemblies 18, without adjusting his or her grip as the device is raised for loading onto the spindle of a piece of plate-loaded equipment.

The present invention has been described with reference to certain preferred and alternative embodiments that are exemplary only and not intended to exclude certain variations and modifications that would occur to those skilled in the art, nor should the embodiments disclosed herein be considered as limiting to the full scope of the invention as set forth in the appended claims.

What is claimed is:

1. An exercise device, comprising:

(a) a weighted plate comprising a circumference; and (b) a straight handle attached to said plate, wherein said handle is rotatable with respect to said plate, said handle is rotatable about an axis lying in a common plane with said plate, and said handle is attached to said plate within said circumference of said plate.

2. The exercise device of claim 1, wherein said handle comprises:

(a) a hollow shaft; and (b) a rod travelling coaxially through said shaft.

3. The exercise device of claim 1, wherein said weighted plate comprises a notch, said notch comprises two corners, and said handle comprises:

(a) a hollow shaft; and (b) a rod extending coaxially through said shaft and through openings in the said corners of said notch in said plate.

4. The exercise device of claim 1, further comprising a resilient coating over said plate.

5. The exercise device of claim 4, wherein said resilient coating is rubber.

6. The exercise device of claim 1, further comprising an ergonomic grip that at least partially coats said handle.

7. The exercise device of claim 1, further comprising a second handle.

8. The exercise device of claim 7, wherein said second handle is attached to said plate at the side of said plate opposite to the location of said handle.

9. The exercise device of claim 8, wherein each of said handles comprises:

(a) a hollow shaft; and (b) a rod extending coaxially through said shaft.

10. An exercise device comprising:

(a) a plate shaped as a disc with at least one notch, wherein said notch is large enough to accommodate the back of a users hand when the user grips the exercise device and rotates the hand into said notch; and (b) a straight handle lying within said notch in a common plane with said plate, wherein said handle is rotatable with respect to said plate, and said handle is rotatable about an axis lying in said common plane.

11. The exercise device of claim 10, wherein said handle comprises:

(a) a hollow shaft; and (b) a rod travelling coaxially through said shaft.

12. The exercise device of claim 11, wherein said rod has a first end and a second end, and said handle further comprises:

(a) two riders, one of said riders travelling coaxially along said first end of said rod and the other of said riders travelling coaxially along said second end of said rod; and (b) a resilient member biasing each of said riders away from the other of said riders.

13. The exercise device of claim 12, wherein said resilient member is a spring mounted coaxially along said rod.

14. An exercise device, comprising:

(a) a weighted plate comprising a circumference; and (b) a handle attached to said plate, wherein said handle is rotatable with respect to said plate, said handle is rotatable about an axis lying in a common plane with said plate, said handle is attached to said plate within said circumference of said plate, and wherein said handle comprises:

(i) a hollow shaft;

(ii) a rod travelling coaxially through said shaft, wherein said rod comprises a first end and a second end, and said handle further comprises two riders, one of said riders travelling coaxially along said first end of said rod and the other of said riders travelling coaxially along said second end of said rod; and (iii) a resilient member biasing each of said riders away from the other of said riders.

15. The exercise device of claim 14, wherein said resilient member is a spring mounted coaxially along said rod.

16. An exercise device comprising:

(a) a plate shaped as a disc with at least one notch, wherein said notch is large enough to accommodate the back of a user's hand when the user grips the exercise device and rotates the hand into said notch; and (b) a handle lying within said notch in a common plane with said plate, wherein said handle is rotatable with respect to said plate, said handle is rotatable about an axis lying in said common plane, and wherein said handle comprises:

(i) a hollow shaft; and (ii) a rod travelling coaxially through said shaft, wherein said rod has a first end and a second end, and said handle further comprises two riders, one of said riders travelling coaxially along said first end of said rod and the other of said riders travelling coaxially along said second end of said rod; and (iii) a resilient member biasing each of said riders away from the other of said riders.

17. The exercise device of claim 16, wherein said resilient member is a spring mounted coaxially along said rod.

* * * * *